US006763626B1

(12) United States Patent
Wieringa

(10) Patent No.: US 6,763,626 B1
(45) Date of Patent: Jul. 20, 2004

(54) PORTABLE TOILET ADVERTISING SYSTEM

(76) Inventor: Lawrence D. Wieringa, 2221 Elsinore Rd., Riverdale, CA (US) 92506

( * ) Notice: Subject to any disclaimer, the term of this patent is extended or adjusted under 35 U.S.C. 154(b) by 38 days.

(21) Appl. No.: 10/233,201

(22) Filed: Sep. 3, 2002

(51) Int. Cl.[7] ..... G09F 7/00
(52) U.S. Cl. ..... 40/611.06
(58) Field of Search ..... 40/584, 594, 611.06, 40/611.01, 606.03, 606.04, 606.05, 606.06; 4/449, 460, 462, 463

(56) References Cited

U.S. PATENT DOCUMENTS

| | | | | | |
|---|---|---|---|---|---|
| 3,005,277 | A | | 10/1961 | Sherron | 40/125 |
| 3,793,756 | A | * | 2/1974 | Kay et al. | 40/606.04 |
| 3,803,738 | A | * | 4/1974 | Weiss | 40/606.04 |
| 4,380,836 | A | * | 4/1983 | Braxton | 4/460 |
| 4,458,455 | A | | 7/1984 | Tollstoff | 52/38 |
| 4,493,118 | A | * | 1/1985 | Braxton | 4/460 |
| 4,831,671 | A | | 5/1989 | Harding | 4/460 |
| 4,914,844 | A | | 4/1990 | Seery | 40/642 |
| 5,398,465 | A | * | 3/1995 | Tagg | 4/449 |
| 5,448,844 | A | * | 9/1995 | Miller et al. | 40/611.06 |
| 5,500,962 | A | * | 3/1996 | Tagg | 4/449 |
| 5,560,050 | A | * | 10/1996 | Tagg | 4/449 |
| 6,115,971 | A | * | 9/2000 | Loebertmann et al. | 4/449 |
| D452,901 | S | * | 1/2002 | Wieringa | D23/299 |
| 6,349,426 | B1 | | 2/2002 | Wieringa | 4/449 |

* cited by examiner

*Primary Examiner*—S. Joseph Morano
*Assistant Examiner*—Lars A. Olson
(74) *Attorney, Agent, or Firm*—Goldstein Law Offices, P.C.

(57) ABSTRACT

An advertising display system, for use with a portable toilet housing having four walls and four corners connecting the four walls. A bracket assembly is attached vertically along each corner. At least three panel assemblies are each selectively mounted between two of the bracket assemblies such that each panel assembly arcs outward to create a substantially semi-cylindrical configuration by the panel assembly which spans across one of the walls. Each panel assembly includes outer panels and a changeable printed sheet extending therebetween. Each bracket assembly includes a T-bracket which provides a space between the T-bracket and the corner of the portable toilet housing to secure one of the panel assemblies therebetween.

16 Claims, 6 Drawing Sheets

PORTABLE TOILET ADVERTISING SYSTEM

BACKGROUND OF THE INVENTION

The invention relates to a portable toilet advertisement display system. More particularly, the invention relates to a system for creating a substantially cylindrical or semicylindrical advertisement space from a substantially rectangular prism shaped portable toilet.

Since companies began advertising their services, the advertising industry has sought new ways to reach potential consumers with advertising messages and slogans. In recent years, advertisers have found a few new advertising mediums, including the Internet, movie product placement, and even ads placed on movie screens prior to the movie start. However, the advertising industry is always seeking fresh media in which to advertise.

U.S. Pat. No. 3,005,277 to Sherron discloses a mounting system for providing advertisements on a telephone booth. U.S. Pat. No. 4,914,844 to Seery discloses a display attachment which allows an advertisement to be attached to a door. U.S. Pat. No. 4,458,455 to Tollstoff de Voss discloses a building set for the display of signs.

My prior U.S. Pat. No. 6,349,426 describes a portable toilet advertisement system which employs a portable toilet to create a new medium for advertisements. In particular the patent describes a cylindrical portable toilet housing which creates an effective advertising display upon what is otherwise "wasted space". This patent provides an effective solution for the production of new portable toilets which are constructed so as to accommodate such advertisements. However, considering the large number of portable toilets already in existence, this patent neglects the possibility of using these existing portable toilets for advertisment.

In addition, my prior U.S. Pat. No. D452,901 illustrates a portable toilet which is cylindrical in shape, and which can easily accommodate an advertisement on a much more pleasing shape than the conventional rectangular portable toilet.

U.S. Pat. No. 4,831,671 to Harding discloses a portable toilet cabana which has a shape similar to most conventional portable toilets, being substantially rectangular prism shaped, but having beveled corner surfaces' which makes the portable toilet substantially octagonal. The present invention, as hereinafter described is well suited for use with this type of portable toilet housing.

While these units may be suitable for the particular purpose employed, or for general use, they would not be as suitable for the purposes of the present invention as disclosed hereafter.

SUMMARY OF THE INVENTION

It is an object of the invention to provide an effective advertisement display on a portable toilet housing and to enhance the appearance of the portable toilet housing. Accordingly, the present invention allows at least three panel assemblies to be attached to a portable toilet housing. The panels can bear an advertising message or simply a decorative image.

It is another object of the invention to allow advertisement display on an existing, substantially rectangular prism shaped, portable toilet housing. Accordingly, the present invention employs brackets which attach onto the existing portable toilet housing to allow the advertisement panel assemblies to be inserted therebetween.

It is a further object of the invention to provide an advertisement display in a semi-cylindrical presentation. Accordingly, the brackets are positioned and the advertising panel assemblies are sized so that the panels arc between the brackets so that adjacent panels together form a nearly continuous arc.

It is a still further object of the invention to provide an advertisement display which can be used to close a portable toilet to the public. Accordingly, three advertisement display panel assemblies are typically positioned across the three walls which do not have the entry door. A fourth advertisement panel assembly may be added to extend across the wall bearing the door, to create a complete cylinder which not only prevents access to the toilet door, but ever makes it uncertain where the door is located, and creates a substantially cylindrical advertisement medium which is particularly suitable for the advertisement of numerous products which are themselves cylindrically shaped.

It is yet a further object of the invention to provide an advertisement which can be easily changed. Accordingly, each advertisement panel assembly is held in place by six securing screws, and can bear different advertisements on each of its two sides. Thus, the advertisement panel assemblies can be easily removed, and "flipped over" to display an alternate advertisement.

It is yet another object of the invention to provide an advertisement that is attractive and highly visible. Accordingly, the T-brackets are preferably made of clear acrylic so as to minimize obscuring the edges of each advertising panel so that they together provide a continuous appearance. The advertisement panel assemblies may be backlit, by simply placing a light source on the outside walls of the portable toilet. Further, the advertisement panels extend substantially the height of the walls. Thus, when all four panels are in place, the system causes the portable toilet to simply look like a cylindrical advertisement display—and not a portable toilet.

It is yet a still further object of the invention that several portable toilet housing can be placed side-by-side to produce a continuous mural. Accordingly, the advertisement can be broken into pieces, which are printed onto individual panels while compensating for the curvature of the panels when ultimately installed between the bracket assemblies. The individual panels are installed onto portable toilets which abut each other side by side. The resulting effect is a mural with a continuous image.

The invention is a advertising display system, for use with a portable toilet housing having four walls and four corners connecting the four walls. A bracket assembly is attached vertically along each corner. At least three panel assemblies are each selectively mounted between two of the bracket assemblies such that each panel assembly arcs outward to create a substantially semi-cylindrical configuration by the panel assembly which spans across one of the walls. Each panel assembly includes outer panels and a changeable printed sheet extending therebetween. Each bracket assembly includes a T-bracket which provides a space between the T-bracket and the corner of the portable toilet housing to secure one of the panel assemblies therebetween.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
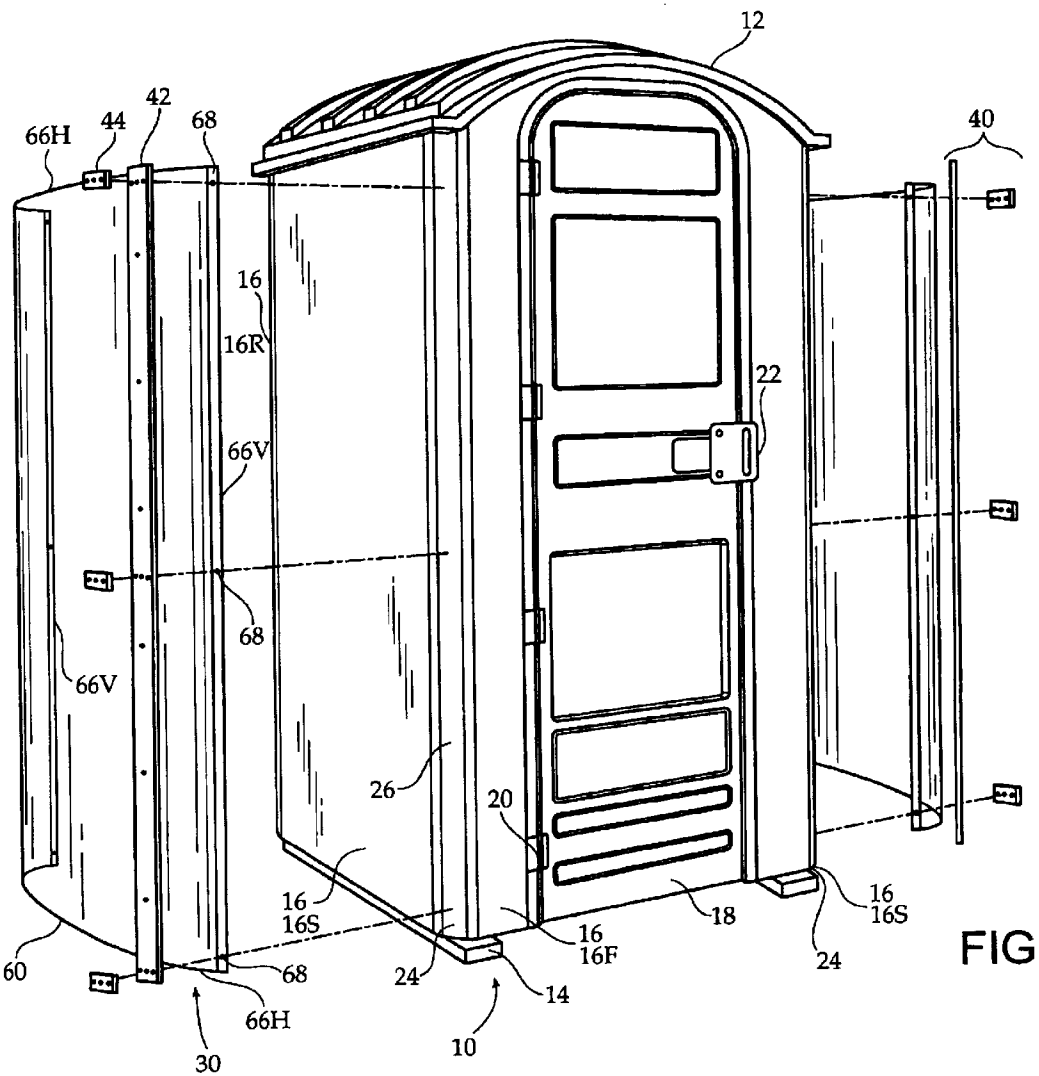
FIG. 1 is a diagrammatic perspective view, illustrating an advertising display system, the general attachment of its bracket assemblies to a typical portable toilet housing, and the arced attachment of its advertising panel assemblies therebetween.

FIG. 1 illustrates a portable toilet housing 10 of a standard configuration, having a substantially rectangular prism configuration, having an arcuate roof 12, a base 14, and four vertically extending walls 16, which extend substantially between the base 14 and roof 12. The walls 16 include side walls 16S, a rear wall 16R, and a front wall 16F. The front wall 16F has a door 18, having hinges 20 and a locking handle 22. The walls 16 meet each adjacent wall with a beveled corner 24. Each beveled corner 24 has a beveled corner surface 26 which extends between adjacent walls, meets each of the adjacent walls at a substantially forty-five degree angle, and extends substantially from the base 14 to the roof 12.

The present invention is an advertisement display system 30, which comprises a plurality of bracket assemblies 40 and a plurality of panel assemblies 60. When used with the portable toilet housing 10 described immediately hereabove, the panel assemblies 60 include four bracket assemblies 40 and three or four panel assemblies 60.

Figure 5:
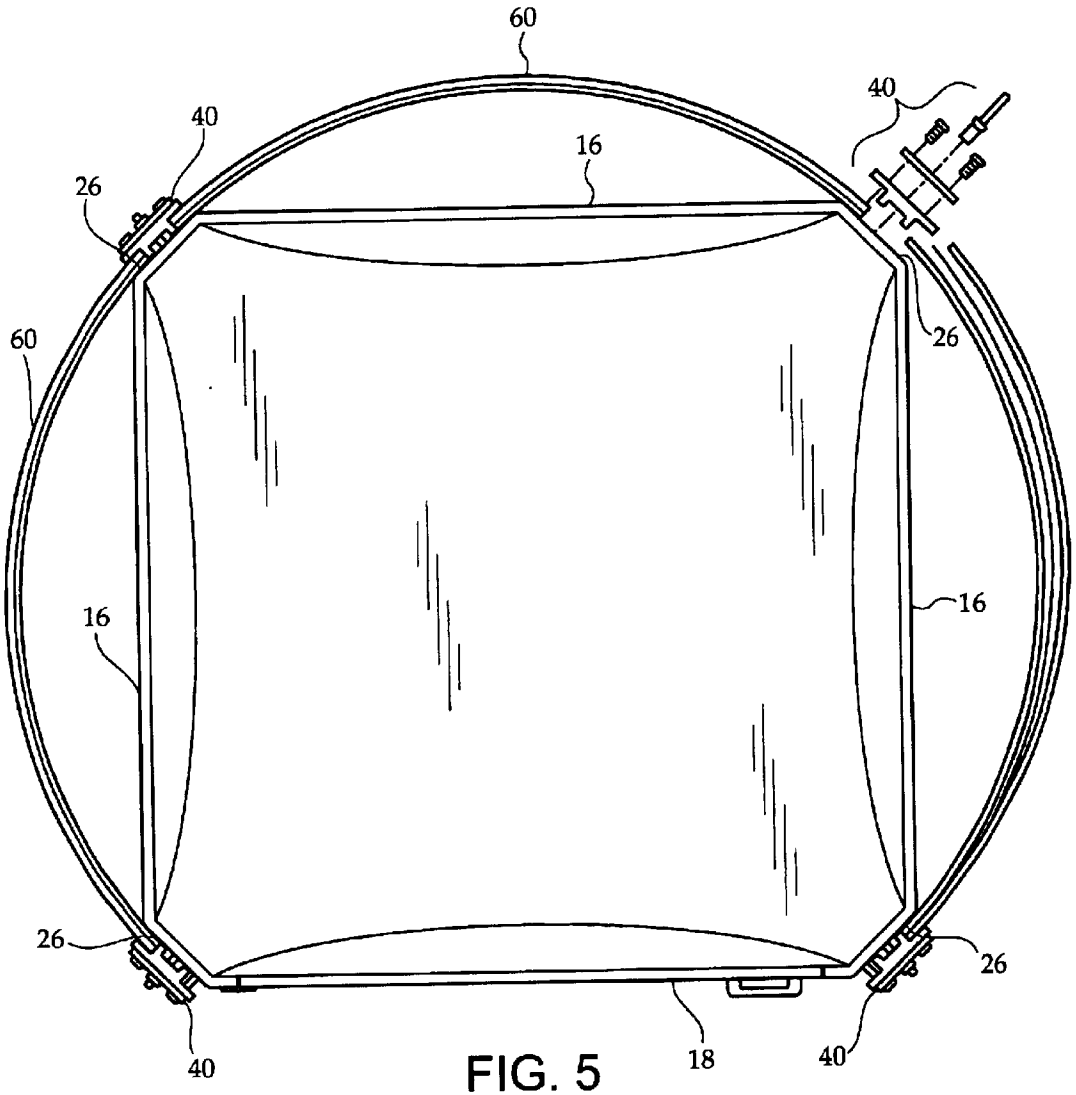
FIG. 5 is a top plan view, wherein two of the advertisement panels and three of the bracket assemblies are installed in place, and wherein one of the bracket assemblies is shown partially removed, and one of the advertising panel assemblies is "fanned out" to illustrate the printed sheet extending between the outer protective panels.
Figure 9:
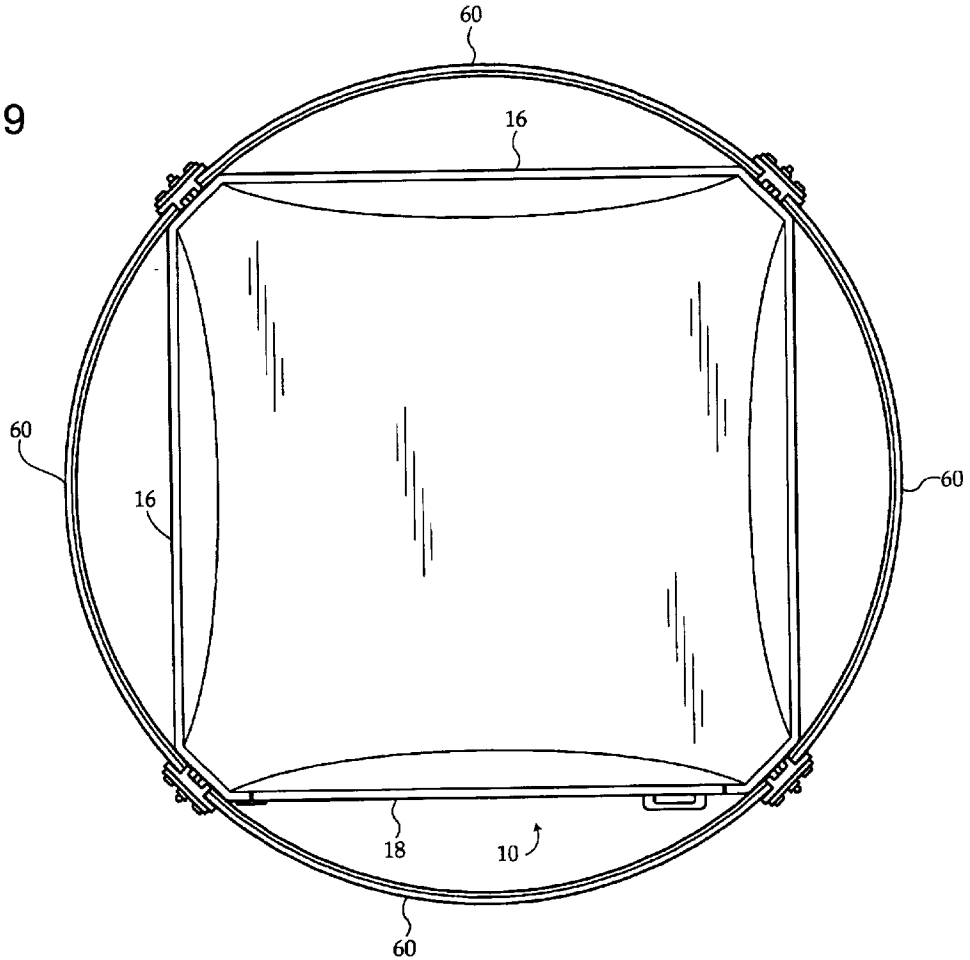
FIG. 9 is a top plan view, similar to FIG. 5, except wherein all four bracket assemblies are installed, and all four advertisement panels are installed—effectively closing the portable toilet to the public, wherein the printed panel is substantially invisible between the two outer protective panels because of its relatively small thickness.

Referring to FIG. 5, each bracket assembly 40 attaches to one of the corner surfaces 26, and each panel assembly 60 spans one of the walls 16 and extends between two of the bracket assemblies 40 mounted to the corner surfaces 26 adjacent to that wall 16. In particular, the panel assemblies 60 are arced between the bracket assemblies to create a semi-cylindrical advertising presentation when three panel assemblies 60 are installed across the walls which do not have the door 18 as shown in FIG. 5. In addition, when four panel assemblies 60 are installed as shown in FIG. 9, to a span all four walls including the wall 16 having the door 18, a substantially cylindrical advertising presentation is created upon the portable toilet housing 10.

Figure 2:
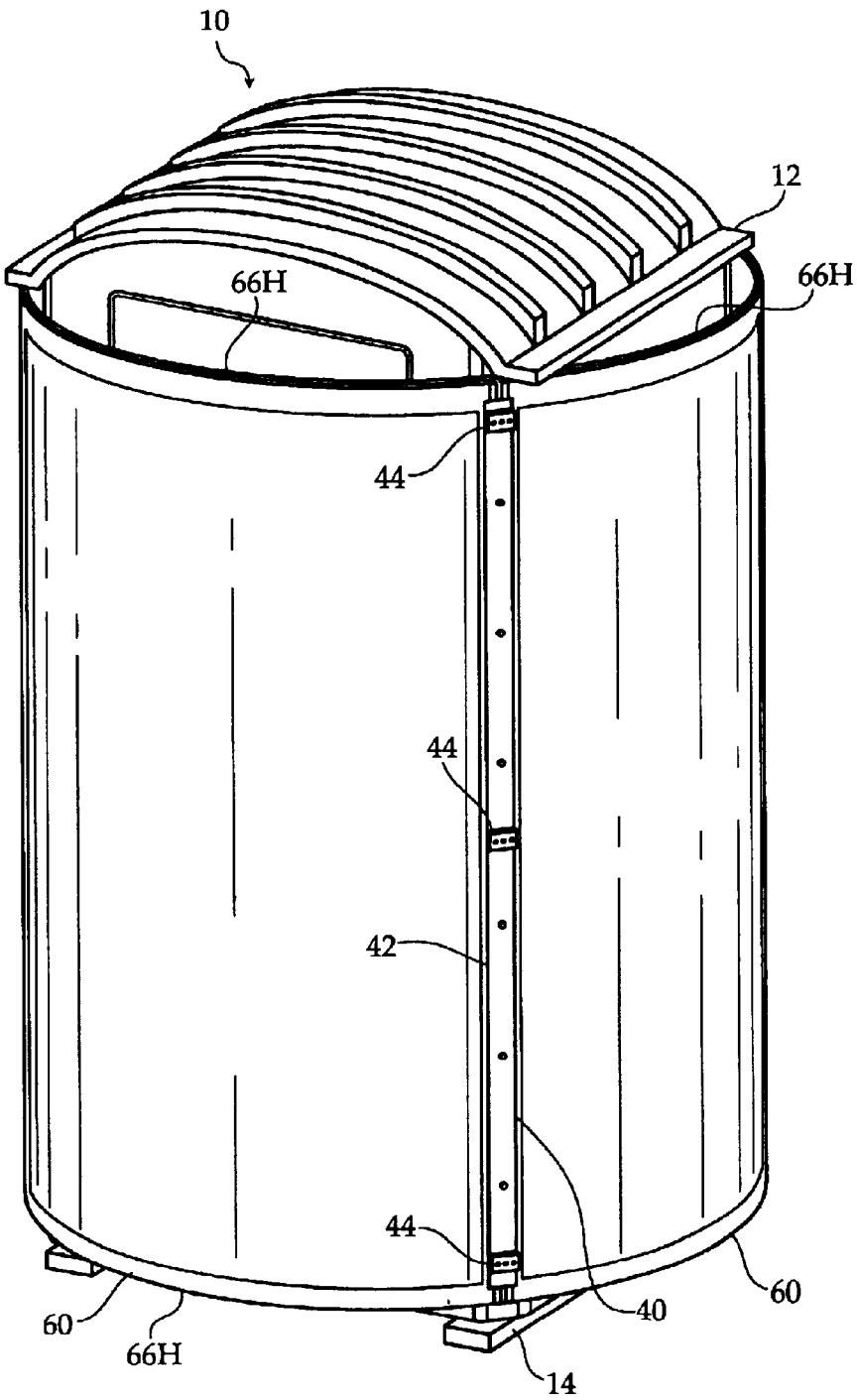
FIG. 2 is a diagrammatic perspective view, illustrating the advertising panels fully installed around the portable toilet housing, including across the door thereof, to create a substantially cylindrical advertising medium having four advertisement panels.

Referring to FIG. 2, each bracket assembly 40 includes an extruded T-bracket 42, and generally three attachment brackets 44. The extruded T-bracket extends substantially between the base 14 and roof 12 of the housing 10. The extruded T-bracket 42 is preferably made of clear acrylic, so that it minimizes blockage along side edges of the advertisement panels 60.

Figures 3, 4:
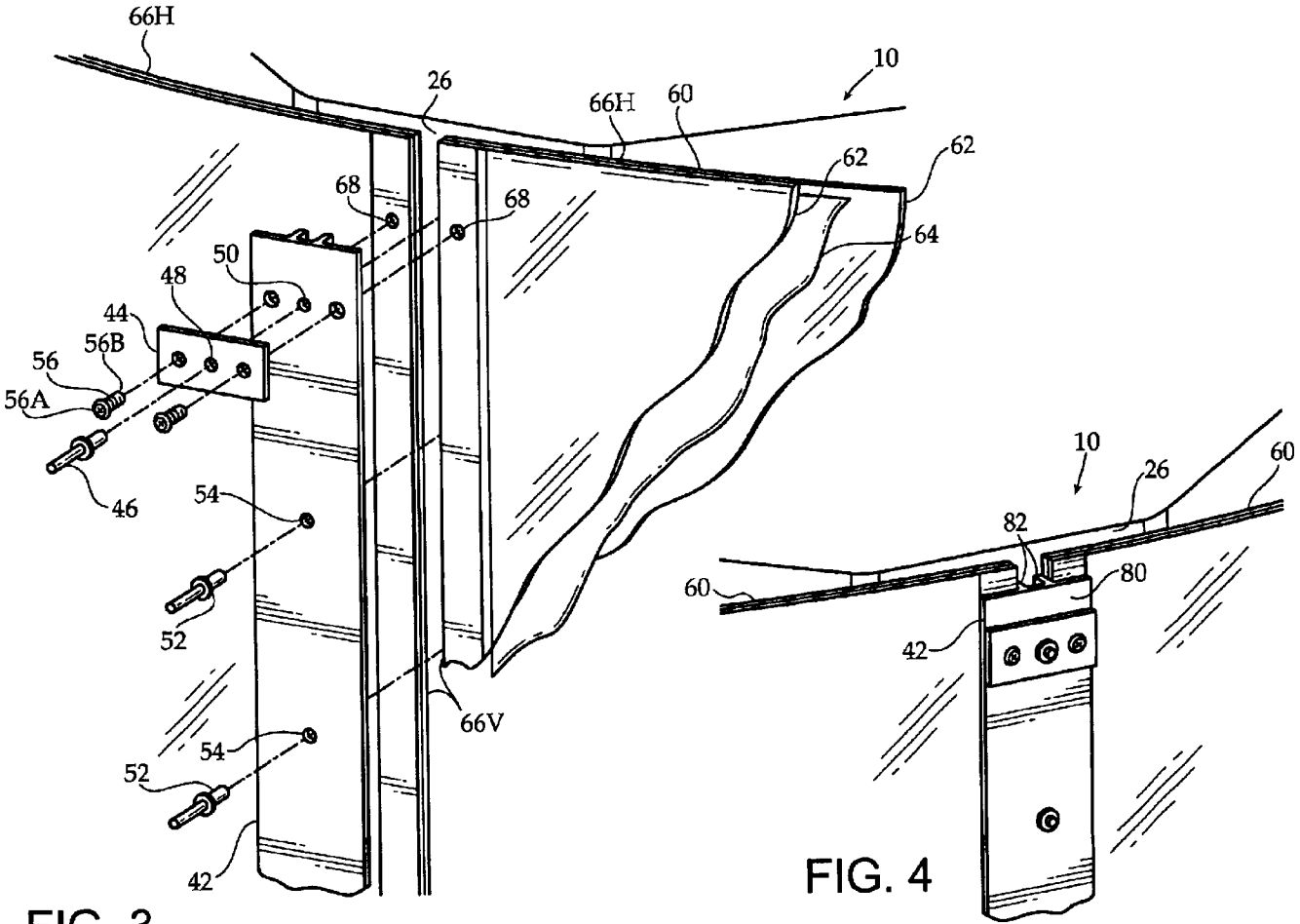
FIG. 3 is a diagrammatic perspective view, detailing attachment of the bracket assemblies to the portable toilet, and the attachment of advertisement panels and advertisement panel assemblies therebetween.
FIG. 4 is a diagrammatic perspective view, detailing a pair of the advertisement panel assemblies installed in place between the bracket assemblies.

Referring to FIG. 3, the T-brackets 44 are rigidly secured to the corner surfaces 26 using the attachment brackets 44, by virtue of main rivets 46 which extend through a central hole 48 in the attachment brackets 44 and through a main rivet hole 50 in the T-brackets 44. In addition, secondary rivets 52 extend through the T-brackets 44 through secondary rivet holes 54 therein, which further secure the T-bracket 44 to the housing 10.

Still referring to FIG. 3, the advertising panel assemblies 60 are held in place by securing screws 56 which extend through the attachment brackets 44, through the T-brackets 42, through the advertisement panel assemblies 60, and against the corner surfaces 26 of the portable toilet housing 10. The securing screws 56 each have a head 56A and a point 56B. When fully tightened, the head 56A of each securing screw 56 extends flush against one of the attachment brackets 44 and the point 56B abuts one of the corner surfaces 26 of the toilet housing 10. Accordingly, the advertisement panel assemblies 60 are secured in place between the T-bracket 42 and the corner surfaces 26 of the portable toilet housing 10, as shown in FIG. 4.

Figure 6:
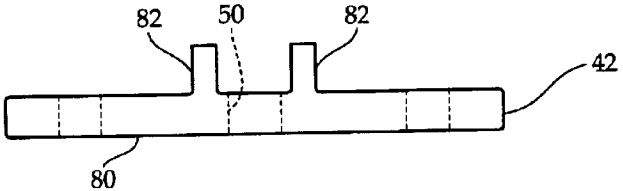
FIG. 6, FIG. 7, and FIG. 8 illustrate various portions of the bracket assemblies.
Figure 7:
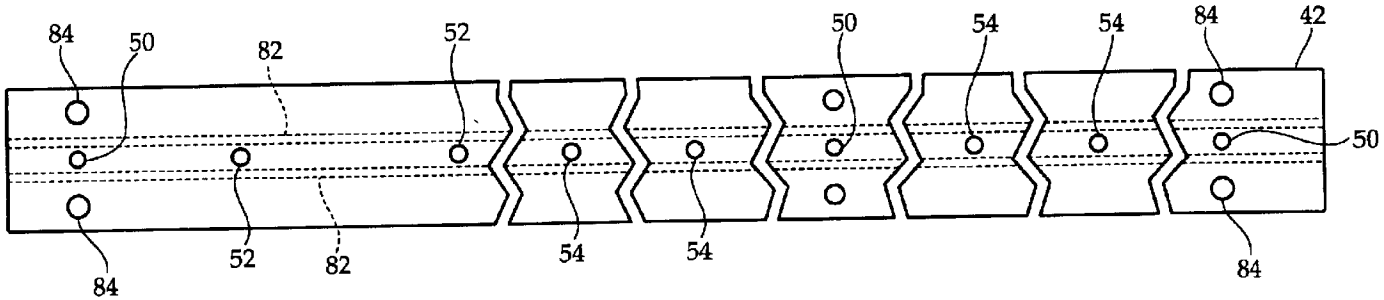
Figure 8A:
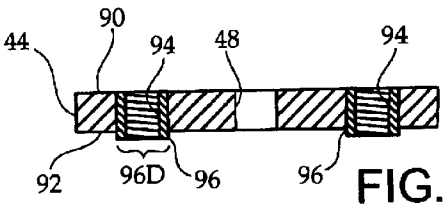
Figure 8:
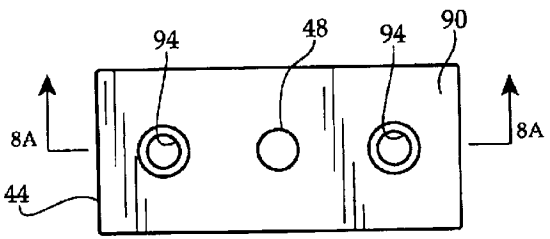

FIG. 6 and 7 detail the T-bracket 42. In particular, FIG. 6 shows that the T-bracket 42 has a broad portion 80, and a pair of legs 82 extending perpendicular thereto and longitudinally along the T-bracket 42. Referring momentarily to FIG. 4, the legs 82 serve to create a vertical space between the broad portion 80 and the corner surfaces 26 when the T-bracket 42 is installed thereon, to provide sufficient clearance for one of the advertisement panel assemblies 60 to extend between the broad portion 80 and the corner surface 26. Referring again to FIG. 6 and FIG. 7, extending through the T-bracket 42 parallel to and between the legs 82 are the main rivet holes 50 and secondary rivet holes 54. The securement bores 84 extending through the broad surface 80 at substantially the same central height as the main rivet holes 50. FIG. 8 and 8A detail the attachment brackets 44. In particular, the attachment brackets 44 each have a top surface 90 and a bottom surface 92. The attachment brackets 44 each have a pair of securing holes 94, and securing nuts 96 extending from the bottom surface 92, concentric with the securing holes 94. The securing nuts 96 have an outside diameter 96D. When the central hole 48 of the attachment bracket 44 is aligned with the main rivet hole 50 of the T-bracket, the securing holes 94, securing nuts 96, and securing bores 84 are concentric. The securing nuts 96 are internally threaded to allow the securing screws 56 (seen in FIG. 3, 4, and 5) to tighten the attachment brackets 42 against the T-bracket 44, which in turn tightens against the toilet housing 10. In this regard, the securement channels 84 are sized to allow the securing nuts 96 to extend therein. In particular, the securement bores 84 are substantially the same in diameter as the securing nut outside diameter 96D. Accordingly, when the securing screws 56 are tightened, the bottom surface 92 of the attachment bracket 44 is flush against the T-bracket 42, as seen in FIG. 4 and FIG. 5. The securing nuts 96 may be connected to the securing brackets 44 in a variety of ways. In particular, the securing holes 94 may be counter-bored from the bottom surface 92 of the attachment bracket to seat the securing nuts 96. Further, the securing nuts 96 may fit fully within the securing holes 94 with an interference fit and protrude from the bottom surface 92 of the attachment bracket 44, as indicated in FIG. 8A. Still further, the securing nuts 96 may be simply adhered to the bottom surface 92 of the attachment bracket 44.

Since the T-bracket is preferably made of clear acrylic, the attachment bracket 44 is preferably made of a more durable material, such as aluminum. Accordingly, the attachment bracket 44 can withstand the stress involved with the repeated tightening and un-tightening of the securing screws 56. Thus, the attachment bracket is provided to allow the use of clear acrylic for the T-bracket, while enhancing the longevity of the T-bracket and thus minimize maintenance for the advertising display system. Although "Philips" type heads 56A are shown for the securing screws 56, it is preferable that 'Allen' type screws be used, to minimize tampering. In this regard, a custom, non-standard size opening on the head 56A may be employed. It is also preferable that 'button head' securing screws be employed, to reduce the chance of snagging and injuring people leaning against or walking closely past the portable toilet housing.

As shown in FIG. 1, preferably three attachment brackets 44 are attached to each T-bracket, at high, medium, and low positions along the T-bracket 42. More particularly, three attachment brackets are used to affix the T-bracket to the toilet housing 10. Referring to FIG. 2, several secondary rivets 52 extend through each T-bracket 42 between the attachment brackets 44, to provide additional rigidity to the connection between the T-bracket 42 and toilet housing 10. When mounted in place, the broad surface 80 of each T-bracket 42 extends substantially parallel to the corner surface 26 to which it is mounted.

Referring to FIGS. 3 and 4, each advertising panel assembly 60, comprises outer panels 62, and a printed sheet 64 extending therebetween. Generally, the printed sheet 64 is interchanged as desired, and the outer panels 62 provide support and protection for the printed sheet. The printed sheet 64 is generally thin, can be double-sided, with different advertisements on each side, and can be backlit with a small light fixture mounted on each of the walls 16 of the portable toilet housing 10. However, if the advertisement is to be backlit, the advertisement should most likely be single-sided. The printed sheet 64 can bear a true advertising message, and can also be printed with a purely decorative image, so as to enhance the appearance of the portable toilet housing Preferably, the outer panels 62 are made of flexible clear polycarbonate sheets, having a preferred thickness of approximately 1/16" inch. The outer panels 62 must have sufficient flexibility to allow them to be arced with the requisite radius, yet be rigid enough to withstand significant deflection and possible inelastic deformation from wind. Each panel assembly 60 has a pair of vertical edges 66V, and a pair of horizontal edges 66H. Most standard portable toilets are have walls which are substantially three and a half feet wide (including the corners) and seven feet tall. Accordingly, to create a cylindrical appearance therearound, it is preferable that the advertising panel assemblies 60 are forty-two inches wide and eighty-four inches tall. However, the size of the advertising panel assembly 60 can be varied according to the portable toilet it is to be used with and the desired effect. To create a true cylinder with the advertising panels 60, the width of each panel can be easily determined as being substantially one quarter the circumference of the smallest circle which extends around all four corner surfaces 26, subtracting the distance occupied by the legs of the T-bracket, as seen in FIG. 9. The precise width needed can be determined without undue experimentation.

The panel assemblies 60 have guide holes 68 extending fully therethrough along the vertical edges 66V. The guide holes 68 are spaced accordingly to the positioning of the attachment brackets 44 so as to allow one of the securing screws 56 from each of the attachment brackets 44 to extend through one of the guide holes 68. Accordingly, preferably three guide holes 68 are located along each of the vertical edges 66V so as to mate with the securing screws 56 extending through the attachment brackets 44 and the T-bracket 42. As seen in FIG. 2, when several advertising panel assemblies 60 are mounted in place, their horizontal edges 66H are substantially aligned at substantially the same height.

In use, the printed sheets 64 are designed so as to contain an advertising message. The printed sheets 64 are designed and printed using conventional graphics techniques. However, the printed sheets 64 should be distorted in the horizontal direction to adjust for the curvature when the advertising panel assemblies 60 are ultimately arced when installed in place on the portable toilet housing 10.

The advertising display system can be easily employed to provide a visual representation of a product which is often contained in cylindrical packaging. For example, a soft drink can or bottle can be at least partially represented by the semi-cylindrical configuration of the advertising display system 30 when three advertising panels are used, or a substantially cylindrical configuration of the advertising display system 30 when four advertising panels are used.

Alternatively, the printed sheets 64 can be configured so that each represents a vertical slice of one continuous image. Each resulting sheet can be installed on an adjacent portable toilet housing 10. For example, said sheets can be installed on the rear walls 16R of several portable toilet housings 10, and those housing 10 can be placed immediately adjacent each other to create a continuous mural.

Generally, three advertising panel assemblies 60 are mounted between the bracket assemblies 40, so that the panel assemblies 60 span the side walls 16S and rear wall 16R, as seen in FIG. 5. In this manner, the display system 30 creates an aesthetically pleasing display from the otherwise unsightly portable toilet housing, and provides its advertising message to those standing in line by the portable toilet housing or otherwise in the proximity thereof. However, at the close of an event, before or after an event, when the toilet is 'out of order', or when it is otherwise desirable to close the toilet to the public, a fourth advertising panel assembly 60 can be mounted in place to span the front wall 16F which has the door 18. Accordingly, a fully cylindrical display is provided, and the toilet housing 10 ceases to provide the appearance of a portable toilet, and instead looks like a round advertising display.

In conclusion, herein is presented an advertising display system which enhances the appearance of a portable toilet, and allows it to be used to provide an advertising presentation. The invention is illustrated by example in the accompanying drawing figures and the foregoing description. Numerous variations are possible, however, while adhering to the inventive concept. Such variations are contemplated as being a part of the present invention.

What is claimed is:

1. An advertising display system, for use on a portable toilet having a base, a roof, four walls, four corners between the walls, each corner defines a corner surface which extends between adjacent walls and meets each of the adjacent walls at a substantially forty-five degree angle, the portable toilet further having a door on one of the walls, comprising:

four bracket assemblies, each bracket assembly having a T-bracket having a broad surface for attaching to and extending vertically on one of the corners such that a space is created between the broad surface of the T-bracket and the corner surface of the portable toilet housing;

at least three panel assemblies, each panel assembly selectively extending across one of the walls by securing to the T-brackets mounted to adjacent corners of the portable toilet housing the panel assemblies for extending between the broad surface of one of the T-brackets and one of the corner surfaces of the portable toilet, the panel assemblies each extend between T-brackets mounted to adjacent corners of the portable toilet housing, the panel assemblies are sized so that they form an arc between the bracket assemblies such that at least three walls are substantially covered by the panel assemblies.

2. The advertising display system as recited in claim 1, wherein the three panel assemblies span across the three walls of the portable toilet housing which do not have the door.

3. The advertising display system as recited in claim 2, wherein each panel assembly has a pair of outer panels, at least one of the outer panels is transparent, the panel assembly also has a printed sheet bearing an advertisement extend, between the outer panels, the printed sheet may be interchanged by removing the panel assembly from the bracket assemblies.

4. The advertising display system as recited in claim 3, wherein the T-bracket has at least two pairs of securing bores, wherein the bracket assembly further comprises a securing screw for each securing bore, and wherein each panel assembly has a pair of vertical edges, each vertical edge having a pair of guide holes, such that when the panel assembly is mounted in place the securing screws extend through the securing bores, through the guide holes, and against the corner surfaces.

5. The advertising display system as recited in claim 3, wherein the T-brackets are substantially transparent, and wherein each bracket assembly further comprises at least two attachment brackets, each attachment bracket has a pair of securing holes and a central hole, and wherein the T-bracket is secured to the corner surface of the portable toilet housing by a fastener extending through the central hole of the attachment bracket, through the main rivet hole of the T-bracket, and into the corner surface of the portable toilet housing.

6. The advertising display system as recited in claim 4, wherein each attachment bracket has a top surface and a bottom surface, wherein the attachment bracket has a pair of nuts extending from the bottom surface and concentric with the securing holes, and wherein the securing screws each extending through one of the attachment brackets, through the securing bores in the T-bracket without engaging the T-bracket, and selectively extend through one of the guide holes in one of the advertising panels and against one of the corner surfaces of the portable toilet housing.

7. The advertising display system as recited in claim 5, wherein the nuts have an outside diameter, and wherein the securing bores of the T-bracket are large enough to allow the nuts to extend into the securing bores so that the bottom surface of the attachment bracket can extend flush against the broad surface of the T-bracket.

8. The advertising display system as recited in claim 6, wherein the T-bracket has a pair of longitudinally extending legs, the legs perpendicular to the broad surface, the legs defining the space between the broad surface and the corner surface to accommodate the advertising panels.

9. The advertising display system as recited in claim 2, further comprising a fourth panel assembly, for selectively securing between the brackets mounted to the corner surfaces adjacent the wall having the door, for selectively covering the wall having the door with said fourth panel assembly and creating a substantially cylindrical display with the four panel assemblies.

10. An advertising display method, using a portable toilet housing having four walls, one of the walls having a door, and four corners between each wall, using a display device having four bracket assemblies and at least three flexible panel assemblies, comprising the steps of:

mounting the bracket assemblies vertically on the corners of the portable toilet housing; and creating a substantially semi-cylindrical display by spanning the panel assemblies across the three walls which do not have the door and arcing each panel assembly away from one of said walls by securing each panel assembly between the two bracket assemblies adjacent the wall said panel assembly spans.

11. The advertising display method as recited in claim 10, further using a fourth panel assembly, wherein the step of creating a substantially semi-cylindrical display is followed by the step of creating a substantially cylindrical display by spanning the fourth panel assembly across the wall having the door and arcing the fourth panel assembly away from said wall by securing the fourth panel assembly between the two bracket assemblies adjacent the wall having the door.

12. The advertising display method as recited in claim 10, wherein each corner of the portable toilet has a corner surface which extends at a substantially forty five degree angle to the walls adjoining the corner, wherein each bracket assembly includes a T-bracket, and wherein the step of mounting the bracket assemblies vertically on the corners of the portable toilet housing further comprises mounting the T-bracket to the corner surface.

13. The advertising display method as recited in claim 11, wherein each T-bracket has a broad surface and legs extending perpendicular to the broad surface, wherein the step of mounting the T-bracket to the corner surface further comprises mounting the legs against the corner surface such that the broad surface extends parallel to the corner surface, and creating a vertical space between the broad surface and the corner surface for allowing one of the advertising panels to extend therebetween.

14. The advertising display method as recited in claim 12, wherein the broad surface of the T-brackets have securing bores, wherein securing screws extend through the securing bores, wherein the panel assemblies have vertical edges having guide holes extending therethrough, and wherein the step of securing each panel assembly further comprises:

extending the vertical edges of said advertising panel into the vertical spaces of the T-brackets adjoining the wall the panel spans;

extending the securing screws from said T-brackets through the guide holes of said advertising panel; and tightening the securing screws against the corner surfaces.

15. The advertising display method as recited in claim 13, wherein each bracket assembly has at least two attachment brackets, wherein each attachment bracket has a front surface, a rear surface, a pair of securing holes, and a pair of securing nuts concentric with the securing holes and protruding from the rear surface, wherein the step of extending the securing screws from the T-brackets through the guide holes of the advertising panel further comprises:

extending the securing nuts of the attachment bracket into the securing bores of the T-bracket; and extending the securing screws through the securing holes and securing nuts through the guide holes.

16. The advertising display method as recited in claim 13, wherein each T-bracket has at least two main rivet holes, each main rivet hole located between the legs of said panel assembly, wherein the attachment bracket has a central hole, and wherein the step of securing the mounting the T-bracket to the corner surface further comprises extending a fastener through the central hole of the attachment bracket, through the main rivet hole of the T-bracket, and into the corner surface of the portable toilet housing.

* * * * *